US008522952B2

(12) United States Patent
Wieczorek

(10) Patent No.: US 8,522,952 B2
(45) Date of Patent: Sep. 3, 2013

(54) HANDRAIL FOR MOVING WALKWAYS, ESCALATORS AND THE LIKE

(75) Inventor: Andre Wieczorek, Leoben (AT)

(73) Assignee: Semperit AG Holding (AT)

( * ) Notice: Subject to any disclaimer, the term of this patent is extended or adjusted under 35 U.S.C. 154(b) by 102 days.

(21) Appl. No.: 12/934,752

(22) PCT Filed: Mar. 23, 2009

(86) PCT No.: PCT/EP2009/053364

§ 371 (c)(1),
(2), (4) Date: Dec. 23, 2010

(87) PCT Pub. No.: WO2009/118284

PCT Pub. Date: Oct. 1, 2009

(65) Prior Publication Data

US 2011/0114443 A1 May 19, 2011

(30) Foreign Application Priority Data

Mar. 27, 2008 (DE) ..... 20 2008 004 206 U

(51) Int. Cl.
*B66B 23/24* (2006.01)

(52) U.S. Cl.
USPC ..... 198/337

(58) Field of Classification Search
USPC ..... 198/337, 335, 338
See application file for complete search history.

(56) References Cited

U.S. PATENT DOCUMENTS 1,956,153 A * 4/1934 Lindquist et al. ..... 198/322
2,211,427 A * 8/1940 Margles ..... 198/331
2,373,764 A * 4/1945 Lautrup et al. ..... 198/337
2,632,550 A * 3/1953 Panter ..... 198/335
3,623,590 A * 11/1971 Johnson ..... 198/337
3,633,725 A * 1/1972 Smith ..... 198/337
3,981,118 A * 9/1976 Johnson et al. ..... 52/716.8
4,776,446 A * 10/1988 Fisher et al. ..... 198/337
4,982,829 A * 1/1991 Johnson et al. ..... 198/337
5,427,359 A * 6/1995 Moulton ..... 256/59
5,477,954 A * 12/1995 Greutter et al. ..... 198/335

(Continued)

FOREIGN PATENT DOCUMENTS

DE 1756354 4/1970
DE 1939241 2/1971

(Continued)

OTHER PUBLICATIONS

International Search Report; PCT/EP2009/053364; Jun. 18, 2009.

*Primary Examiner* — Gene Crawford
*Assistant Examiner* — Keith R Campbell

(57) ABSTRACT

Handrail having laterally bent edges which engage around laterally projecting ribs of a guide element such that the ends of the bent edges are situated at a clear distance from one another and each at a distance from a guide base of the guide element where the clear distance corresponds to a total gap size plus a width of the guide base and is chosen in consideration of the width of the guide base and the shrinkage and warpage phenomena occurring during operation to not exceed 8 mm, while a clear width of the bent edges is chosen to be greater than the width of the guide element at the ends of the laterally projecting ribs such that, considering tolerances of the width of the guide element at the ends of the ribs and the shrinkage and warpage phenomena occurring during operation of the handrail, not exceed 8 mm.

4 Claims, 1 Drawing Sheet

(56) References Cited

U.S. PATENT DOCUMENTS

| | | | | |
|---|---|---|---|---|
| 7,562,759 | B2 * | 7/2009 | Guo et al. | 198/337 |
| 7,571,797 | B2 * | 8/2009 | Lee | 198/335 |
| 7,802,670 | B2 * | 9/2010 | Durrer et al. | 198/337 |
| 2002/0084169 | A1 * | 7/2002 | Schulte et al. | 198/337 |
| 2005/0011735 | A1 * | 1/2005 | Durrer et al. | 198/844.2 |
| 2008/0308385 | A1 * | 12/2008 | Lee | 198/335 |
| 2009/0071798 | A1 * | 3/2009 | Durrer et al. | 198/337 |

FOREIGN PATENT DOCUMENTS

| | | |
|---|---|---|
| DE | 2129582 | 12/1972 |
| EP | 0530944 | 3/1993 |
| JP | 11255459 | 9/1999 |
| WO | 2006029706 | 3/2006 |

* cited by examiner

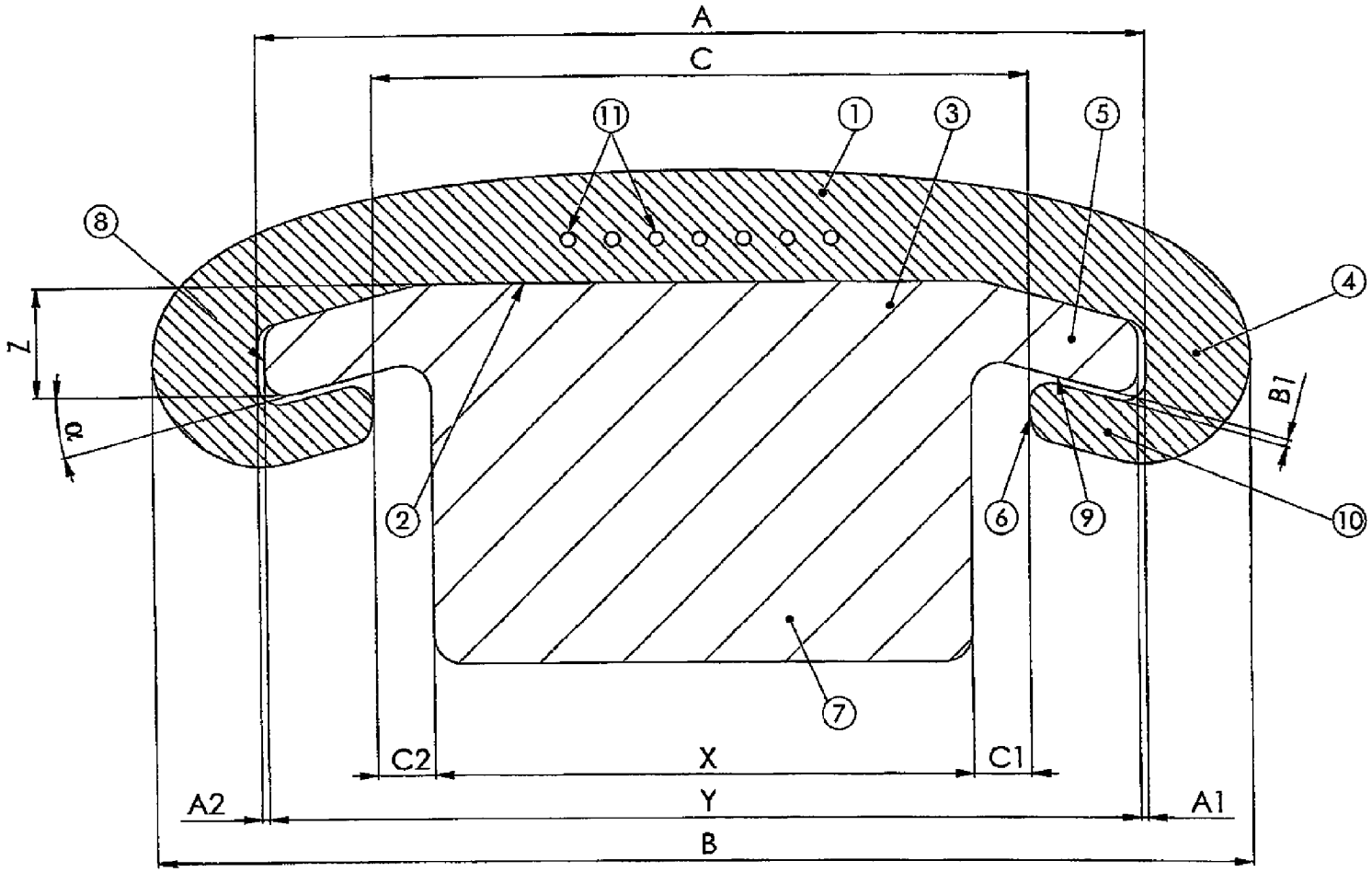
A
C
1
11
3
5
8
Z
α
2
4
B1
10
9
6
7
X
Y
C1
C2
A1
A2
B

HANDRAIL FOR MOVING WALKWAYS, ESCALATORS AND THE LIKE

The invention relates to a handrail for moving walkways, escalators or the like of the kind mentioned in the preamble of claim 1 which can be mounted on a guide element.

Such handrails are already known (EP 0 530 944 A1, DE 17 56 354 A, DE 19 39 241 A and DE 21 29 582 A). There, it has been recognized that the cross-sectional dimensions of the handrails change over their lifespan in operation in escalators, moving walkways and the like due to the dynamic stresses caused by alternating positive and negative bending of the handrail during its passage through escalators, moving walkways or the like as a result, in particular, of shrinkage and warpage phenomena. To avoid these problems, it is known to install such materials and inserts which keep the amount of shrinkage within small limits. Such handrails, however, require sufficient clearance with respect to the surfaces of the guide elements and their guide bases so that the friction and, thus, the driving forces for moving the handrails on the guide element do not get too great. In addition, one also has to take care that any gaps at the handrail into which people using escalators might reach with their hands do not cause any injury.

It is the object of the invention to improve the handrail such that, over its entire lifespan, a safe operation which is up to standard and takes account of safety provisions is made possible without having to exert too great driving forces to drive the handrail. Furthermore, if possible, the amount of material used to achieve this object should be kept small.

The invention is characterized in claim 1, and further embodiments of the invention are claimed in the dependent claims.

The FIGURE schematically shows a preferred embodiment of the invention.

According to the invention, the clear distance C of the ends of the bent edges of the handrail, which consists of the total gap size C1+C2 plus the width X of the guide base at the relevant point, is chosen such that, taking into account the tolerances of the width X of the guide base and the shrinkage and warpage phenomena which result during the operation of the handrail, the total gap size C1+C2 does not exceed 8 mm. The clear width A of the bent edges 4 is to be chosen to be greater, by a total gap size A1+A2, than the width Y of the guide element at its lateral ribs such that, taking into account the tolerances of the width Y of the guide element at the ends of the ribs and the shrinkage and warpage phenomena which result during the operation of the handrail, the total gap size A1+A2 does not exceed 8 mm.

When dimensioning the handrail according to the invention, the starting point is the cross-section of the guide element and its guide base. The adaptation of the handrail to the guide element makes it necessary that, in the manufacture, all shrinkage and warpage occurrences influencing the cross-section of the handrail are under control and can be reproduced. Therefore, the respective handrail is adapted to the respective configuration of the guide element and its guide base. The cross-sections of the production tools as well as the semi-finished products are adjusted such that a reproducible shaping within close tolerances is ensured. This applies in particular to press forming processes, in particular extrusion molding and extrusion processes.

Here, also the contours of the handrail as well as changes in the contours of the handrail during operation have to be taken into account in the course of bench tests and/or calculations; also the material characteristics and the kind of stresses occurring during operation play a role, which can be optimized by carrying out preliminary tests.

In the case of constant or increasing gap sizes during the operation, the cross-section enclosed by the handrail is determined by the outer contour of the guide element and its guide base. The upper tolerance limit of the guide element predetermines the lower tolerance limit of the inner contour of the handrail. Thus, it is ensured that the handrail is not stuck on the guide element, but can be easily moved. The handrail is then designed such that the change in the gap size during the course of operation, i.e. during the lifespan of the handrail, is limited by the total gap size C1+C2.

If the gap size reduces during operation, the inner contour of the handrail is defined by the upper tolerance limit of the clear width C in connection with the lower tolerance limit of the guide element and its guide base. In this case, the total gap size C1+C2 should not exceed a value of 8 mm.

The cross-section of the handrail has to be dimensioned such that, over its entire lifespan, the handrail cannot stick to the guide element, but can be moved easily without exerting too much force.

In both cases, one has to make sure that the handrail is sufficiently safe in operation, in particular when used by human beings.

Therefore, according to the invention the handrail can be purposefully adapted to specific guide elements of specific customers without having to use particularly massive handrails. Consequently, a reduction in price in the manufacture is a further positive result of the invention.

According to an embodiment of the invention the lateral ribs of the guide element can be inclined by an angle $\alpha$ with respect to the plane of the sliding surface of the handrail or upwardly bent; the bent edges of the handrail are also bent by approximately this angle towards the inside in the direction towards the sliding surface. This provides for an additional supporting function against a lateral sliding of the handrail away from the guide element. In this case, the laterally protruding ribs of the guide element can be designed to be somewhat shorter than in the non-angled arrangement. The gap size B1 between the underside of the ribs and the inwardly bent end parts of the lateral edges should be less than 6 mm.

As a matter of course, also in the invention the use of inner strengthening means in the handrail is possible so as to ensure a certain transverse rigidity.

The FIGURE shows a schematic cross-section of an embodiment according to the invention.

The handrail 1 curved according to the outer contours, which handrail is made of elastomer or rubbery-elastic material, respectively, e.g. crosslinked elastomers such as SBR, CSM, EPDM, CR, NR, as well as thermoplastic elastomers such as TPE and TPU, is seated at its underside in this case essentially flatly on the sliding surface 2 of the guide element 3 such that the handrail 1 can be moved along in the longitudinal direction, i.e. in a slidable manner perpendicular to the cross-sectional representation or, if rolls are used, also in a rollable manner. The guide element 3 has lateral ribs 5, i.e. ribs extending also in the longitudinal direction, which can be angled downwards by an angle $\alpha$, i.e. towards the guide base 7. The width Y of the guide element 3 at the outer edges 8 of the lateral ribs 5 is slightly smaller than the clear width A of the handrail 1 at that point where the edges 4 are bent around the ribs 5 up to the end parts 10. This leads to the gap sizes A1 and A2 at the sides.

The clear width C of the inner ends 6 of the handrail 1 is larger, by the total gap size C1+C2, than the width X of the guide base 7. As a consequence, there are gaps of the gap sizes C1 and C2, respectively, between the inner ends 6 of the handrail 1 and the guide base 7.

The distance of the parts of the ribs 5 which are drawn furthest down from the upper sliding surface 2 of the guide element 3 is designated by Z so that the gap size B1 results from the distance of the inner end parts 10 of the handrail 1 from the downwards pointing sides 9 of the ribs 5, which sides are inclined by the angle α.

The handrail 1 has the total width B. This width is 70 mm, for example.

The handrail can be provided, in particular in its center part, with inner strengthening means 11 so as to improve the transverse rigidity and tensile strength without impairing the mobility in the direction of transport along the guide element 3.

Preferred dimensions in this embodiment are as follows

A1=57 mm
A1+A2=2 mm
B=70 mm
B1=1 mm
C=38 mm
C1+C2=2 mm
Y=55 mm
Z=8 mm
α=15°

The ratio between the total gap size C1+C2 and the total gap size A1+A2 should be between 0.125 and 8.

The angle α should be between −45° and +45°.

The distance Z should be between 4 and 12 mm.

The ratio Y:X should be between 1.1 and 5.

The invention claimed is:

1. A handrail which can be mounted on a guide element and which is intended for moving walkways, escalators or the like, in which an inner sliding surface (2) of the handrail (1) is supported such that it can slide or roll on the guide element (3), said handrail having laterally bent edges (4) which engage around laterally projecting ribs (5) of the guide element (3), which are straight or inclined by an angle α or upwardly bent, to such an extent that the ends (6) of the bent edges (4) are situated at a clear distance C from one another and each at a distance—(C1or C2)— from the guide base (7) of the guide element (3), characterized in that the clear distance C of the ends (6) of the bent edges (4) of the handrail (1) corresponds to the total gap size C1+C2 plus a width X of the guide base (7) at the relevant point and is chosen such that, taking into account the tolerances of the width X of the guide base (7) and the shrinkage and warpage phenomena which result during the operation of the handrail (1), the total gap size C1+C2 does not exceed 8 mm, while a clear width A of the bent edges (4) is chosen to be greater, by a total gap size A1+A2, than the width Y of the guide element (3) at the ends (8) of the laterally projecting ribs (5) such that, taking into account the tolerances of the width (Y) of the guide element (3) at the ends (8) of the ribs (5) and the shrinkage and warpage phenomena which result during the operation of the handrail (1), the total gap size A1+A2 does not exceed 8 mm, wherein the ribs (5) of the guide element (3) are inclined by an angle α with respect to the sliding surface (2) of the handrail (1) and the bent edges (4) of the handrail (1) at their end parts (10) are also bent upwards towards the inside in the direction towards the sliding surface (2) by approximately this angle.

2. The handrail according to claim 1, characterized in that the gap size B1 between the underside (9) of the ribs (5) and the end parts (10) of the side edges (4) bent inwards is smaller than 6 mm along the entire guide elements.

3. The handrail according to any one of the preceding claims, characterized in that the handrail (1) has inner strengthening means (11) which provide the handrail (1) with a high transverse rigidity and tensile strength.

4. A handrail assembly intended for moving walkways, escalators or the like, comprising:

a guide element comprising a guide base, an upper planar surface disposed atop the guide base, a first lateral rib extending outwardly from a first side of the planar surface, and a second lateral rib extending from a second opposite side of the planar surface, where the first and second lateral ribs are inclined in a direction away from the planar surface toward the guide base, and where the planar surface extends uninterrupted from the first to the second lateral rib;

a handrail disposed upon the guide element where the handrail slidingly engages the planar surface and an upper surface of each of the lateral ribs, the handrail including opposing end portions which extend around and beneath the first and second lateral ribs and delimit a gap between a bottom and a side of each lateral rib and the handrail, the handrail extending parallel to the bottom of each of the lateral ribs at the angle of incline of the ribs;

wherein the gap between the handrail and the sides of the first and second lateral ribs totals about 2mm;

wherein the gap between the handrail and the bottom of the first and second lateral ribs totals about 2mm; and wherein the incline of each of the first and second lateral ribs is about 15 degrees.

* * * * *